US006813838B2

(12) United States Patent
McCormick

(10) Patent No.: US 6,813,838 B2
(45) Date of Patent: Nov. 9, 2004

(54) GARMENT FITTING SYSTEM

(76) Inventor: Bruce McCormick, 16331 Clearcrest, Houston, TX (US) 77059

( * ) Notice: Subject to any disclaimer, the term of this patent is extended or adjusted under 35 U.S.C. 154(b) by 104 days.

(21) Appl. No.: 10/341,656

(22) Filed: Jan. 14, 2003

(65) Prior Publication Data

US 2003/0171839 A1 Sep. 11, 2003

Related U.S. Application Data

(60) Provisional application No. 60/348,712, filed on Jan. 14, 2002.

(51) Int. Cl.[7] ..... G06F 19/00

(52) U.S. Cl. ..... 33/17 R; 33/2 R; 33/8

(58) Field of Search ..... 33/17 R, 2 R, 33/8, 11, 12, 16, 17 A; 700/131, 130, 132, 133, 134, 135, 136; 705/1, 10, 26; 707/4, 104

(56) References Cited

U.S. PATENT DOCUMENTS 2,028,871 A * 1/1936 Johnston ..... 33/8
2,780,003 A * 2/1957 Cloward ..... 33/16
3,522,656 A 8/1970 Paranzino
4,186,489 A 2/1980 Vigilante et al.
4,417,401 A * 11/1983 Aisaka et al. ..... 33/512
5,163,007 A 11/1992 Slilaty
5,315,666 A 5/1994 Norton-Wayne
5,530,652 A 6/1996 Croyle et al.
5,680,314 A 10/1997 Patterson et al.
5,680,528 A 10/1997 Korszun
5,930,769 A 7/1999 Rose
6,286,224 B1 * 9/2001 Lewis ..... 33/562
6,353,770 B1 * 3/2002 Ramsey et al. ..... 700/131

* cited by examiner

*Primary Examiner*—Christopher W. Fulton
(74) *Attorney, Agent, or Firm*—Reising, Ethington, Barnes, Kisselle, P.C.

(57) ABSTRACT

A method and device for fitting a ready-made garment to the body of an individual person with a fit that meets the individual person's preference, the method comprising the steps of; selecting an existing garment from the individual person's own wardrobe, the garment having a preferred fit on the individual person, measuring a prescribed set of critical dimensions of the existing garment and recording the dimensions with an identification of the individual person, and manufacturing one or more garments having said critical dimensions.

5 Claims, 4 Drawing Sheets

GARMENT FITTING SYSTEM

This application is based upon Provisional Application No. 60/348,712, filed Jan. 14, 2002, and the benefit of the priority thereof is hereby claimed for this application.

FIELD OF THE INVENTION

This invention relates to a method and apparatus for fitting ready-made garments to individual persons and to a garment retailing system applicable to store, catalog and internet retailing.

BACKGROUND OF THE INVENTION

In the ready-made clothing industry, the supply chain from the manufacturer to the consumer has become very inefficient in respect to the ordering and inventory of goods to meet the actual needs of the consumer. A particularly difficult problem in this supply process involving ready-made garments is that of specifying garment sizes in sufficient detail to satisfy the widely varying needs of consumers with respect to the fit of ready-made garments. In today's marketplace, the need for ready-made garments is supplied by mass production of many types of garments with a wide range of sizes in each type which are offered for purchase by the individual consumer in the retail store, by catalog order or internet order. In the purchasing process by the consumer, the most troublesome problem is that of finding a garment which fits the individual person's body in such manner that it provides both comfort and appearance desired by the purchaser. Yet, the size of the ready-made garment is conventionally designated to the consumer by size labels which are so general that the consumer usually has to try on several garments to find a suitable fit. In garments such as shirts, blouses and jackets the size is commonly indicated on the garment as large, medium or small. In garments such as trousers, the size is commonly given by two numbers indicating waist size and leg length. Given the wide variety in size and configuration of the human physique coupled with different personal tastes in the fitting of garments, the limited information given by size labels leaves the consumer to a process of trial and error in selecting a garment with a satisfactory fit.

When a consumer purchases a garment, for example a pair of jeans, the consumer begins the process by searching through a stack of jeans that are labelled by the manufacturer with a waist dimension and an inseam dimension. The consumer may, at considerable risk of misfit, purchase the jeans based on the stated "sizes" or may go through the trial and error process of trying on the jeans in a fitting room. It is well-known that there is a significant variation in the fit of different garments which are labelled with the same size. Such variations may be the result of various factors including manufacturing tolerances, mislabeling, marketing efforts, shrinking and variation of styles.

The purchasing process in the ready-made garment industry may be characterized as a trial and error selection of a satisfactorily fitting garment. This is a burden on the consumer and is reflected, with different degrees of severity, in retailing inefficiency of store sale, catalog sales and internet sales because of the need for returns and exchanges of ill-fitting garments and the accompanying problems of inventory control and goodwill.

In these circumstances, there is a need for improving the efficiency of the purchasing process of ready-made garments.

SUMMARY OF THE INVENTION

In accordance with this invention, there is provided a method of fitting a ready-made garment to the body of an individual person with a fit which meets the individual person's preference. This is accomplished having said person select from a person's own wardrobe an existing garment which has a preferred fit and measuring a prescribed set of critical dimensions of the garment. The critical dimensions are recorded along with an identification of the individual person and one or more garments are manufactured having said critical dimensions.

Further, in accordance with this invention, the method of fitting a garment to an individual person's body is applied and used in the ready-made garment industry by both the garments manufacturers and garment retailers. The method, as used by a manufacture, comprises the establishment of a set of critical garment dimensions for each type of garment to be manufactured and manufacturing one or more garments of a given type with critical dimensions having a prescribed unique set of values which correspond to the preferred fit for at least one individual person. Further, in accordance with the invention, a garment retailer maintains an inventory of said given type of garment in the range of different sizes each of which is specified by a unique set of critical dimensions.

Further, in accordance with this invention, the retailer which may be a store, catalog or internet retailer, accepts orders from individual persons for a garment having that individual person's preferred fit with a size specification which comprises a unique set of values for each of the critical dimensions.

A complete understanding of this invention may be obtained from the detailed description that follows taken with the accompanying drawings.

BEST MODE FOR CARRYING OUT THE INVENTION

Figure 1:
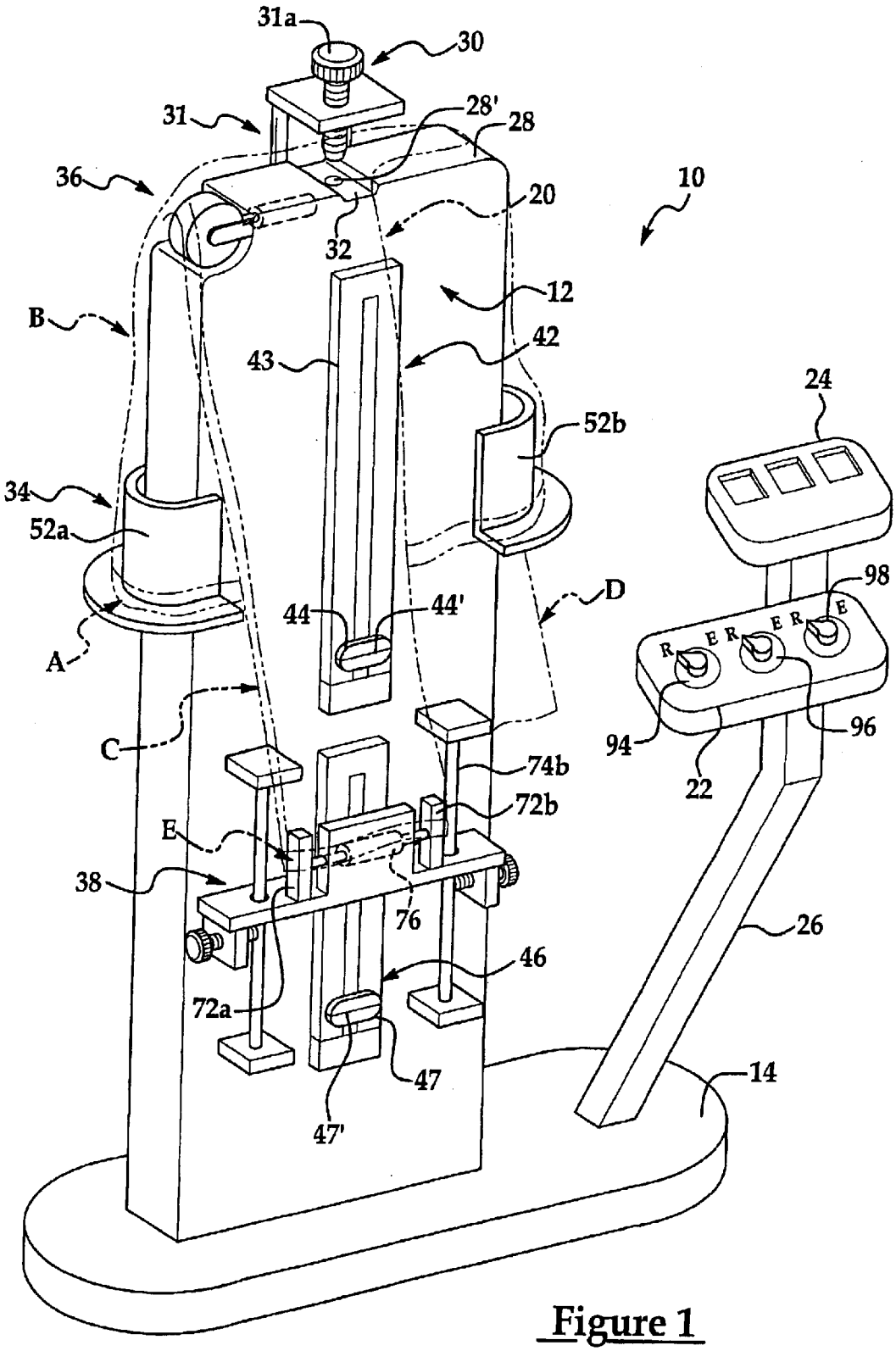
FIG. 1 is a perspective view of a measuring apparatus of this invention for obtaining critical dimensions of a trousers.

In the description that follows, an illustrative embodiment of the method and apparatus of this invention will be set forth with reference to size designation and labeling of ready-made garments such as trousers and shirts in relation to the purchasing process including manufacturers, retailers and consumers. Further, measuring apparatus for particular types of garments such as trousers and shirts will be described with reference to an illustrative embodiment of the invention. It will be appreciated, as the description proceeds, that the invention is applicable to a wide variety of garments and may be implemented in a variety of different embodiments.

This invention relates to a new and improved method for determining and specifying a preferred fit of a given type of garment to an individual person's body. It also relates to a method of determining and specifying a preferred fit, i.e. size, of a garment for use by manufacturers and in retail sales including store, catalog and internet sales. Further, the invention relates to a new and improved measuring apparatus for determining critical dimensions of a garment for fitting the body of an individual person in a preferred fit according to the desires of that person.

Before describing the measuring apparatus shown in the drawings, a general description of the method of determining a preferred fit of an individual person will be described.

Method of Determining and Specifying a Preferred Fit

As used herein, the term "ready-made garment", means an item of clothing which is manufactured in large quantities for off-the-shelf purchase via a retail store, a catalog or an internet web site with a size designation usually given on a label. A ready-made garment is to be distinguished from a "custom made" garment which, as used herein, means an item such as a trousers which is specifically made to fit an individual person's body so as to obtain a fit which is preferred by that person. For achieving this preferred fit, custom-made clothing requires taking direct measurements on the individual person's body to obtain critical dimensions before cutting and sewing the item. After the garment is made, it is not uncommon to have it adjusted to obtain a good or preferred fit. As used herein the term "preferred fit" means whatever fit an individual consumer desires for himself/herself, regardless of whether the garment is custom-made or ready-made.

In accordance with this invention, a method of determining and specifying the preferred fit of a specific garment for an individual person's body is as follows. First, the individual person selects from his or her wardrobe an existing garment which has a preferred fit to that person's body. Then, a prescribed set of dimensions, i.e. critical dimensions, of the selected garment are measured and recorded for use in making and/or selecting a garment for that person. The set of critical dimensions includes dimensions which will cause the garment to conform to the individual person's body in a preferred fit. The set of critical dimensions depends upon the type of garment but, for each type, the dimensions in the set relate to the same part or feature of the garment. For example, in a trousers, a set of critical dimensions comprises the dimensions of the waist, hips, inseam, front rise, rear drop, and cuffs. Further, some of the critical dimensions need to be measured from a common reference or datum point. In the case of trousers, the datum point is preferably located at the "crotch joint", i.e. at the inseam sewing junction in the crotch of the trousers and serves as the datum point for measuring the length of the inseam, the rise and the drop of the trousers.

Use of the Invention in Ready-Made Garment Industry

The method of measurement of this invention is useful for improving the efficiency of the purchasing process in the ready-made garment industry. The measurement method, as described above, provides a basis for supply of ready-made, preferred fit garments to the consumer at reduced costs with greatly improved customer satisfaction. Use of the measurement method will enable a manufacturer to supply the preferred fit garments and thus achieve a reputation for meeting customer satisfaction in regard to the fit of the manufacturer's garments. The retailer will benefit from the reduced number of returns of its products by customers because of ill-fitting garments as compared with the current trial and error method of fitting in store retailing, catalog retailing and also in internet retailing. The entire industry will benefit from greater consumer goodwill and from greater efficiency in the purchasing process.

In use, the garment measuring system of this invention can be adopted gradually in the ready-made garment industry by garment manufacturers and by retailers. It would be desirable, but not necessary, for the industry to adopt a standard in respect to the set of critical dimensions to be measured and the size designation format for each type of garment for use in inventory control, data banks and garment labels. The start-up of use, whether by a manufacturer or a retailer, will require availability of a measuring apparatus which provides accurate measurement, reliability of repeatable measurements, low cost and easy to use apparatus. An exemplary measuring apparatus, in accordance with this invention, will be set forth below.

An example of start-up by a store retailer would include the following steps: (1) Obtaining a measuring apparatus for a selected type of garment, such as trousers; (2) using the measuring apparatus for taking, recording measurements and labeling trousers in the store inventory; (3) providing a measuring apparatus in the store for use by customers for measurement of the customer's existing garment which provides the customer with a preferred fit; (4) recording the customer's name, type of garment, the set of critical dimensions, date of measurement, etc.; (5) searching the store inventory for trousers which have the customer's set of critical dimensions and hence provide a preferred fit; and (6) showing the trousers having the preferred fit to the customer for the customer to select one for purchase. In the case of start-up of remote purchasing by a catalog or an internet retailer, the retailer will make a measurement apparatus available for use in the locality of prospective customers. In this case, the communication between the prospective customer and the retailer is suitably provided through a computer link between the site of the measurement apparatus and the retailer.

In the case of start-up by a garment manufacturer, the manufacturer will use the measuring apparatus to measure the critical dimensions of all the manufacturer's inventory and label each garment accordingly. In the case of new garments to be manufactured, a manufacturer may design and manufacture each type of garment such as trousers, in different sizes as specified by different sets of critical dimensions so that retailers can order garments by specifying the critical dimensions.

First Embodiment of Garment Measuring Apparatus

Referring now to the drawings, there is shown an embodiment of the measuring apparatus for measuring the critical dimensions of trousers.

As shown in FIGS. 1–5, the measuring apparatus 10 comprises, in general, an upright measurement frame 12 which is supported on a base 14 and is adapted to support a trousers 20 (see trouser depicted in dashed line in FIG. 1) for measurement by measuring instruments installed on the frame. The apparatus 10 also includes a control panel 22 and a display panel 24 which are mounted to the base 14 by a pedestal 26. The frame 12 is generally rectangular in shape and is a box-like structure adapted to support certain parts of the measuring instruments in its interior space. The measurement frame 12 terminates at its upper end in a horizontal support surface 28 which defines a transverse groove 32 which has a marked reference point 28' represented by a bulls eye, at a central location in the groove 32. For taking certain measurements of the trouser 20, as will be discussed below, the datum point on the trousers, i.e. the crotch joint, must be located at the reference point 28' in the bulls eye. In order to hold the crotch joint in position during measurement, a keeper clamp 30 is provided. The keeper clamp comprises a hand-screw 31*a* in a support bracket assembly 31 which is mounted on the frame 12. The hand-screw 31*a* is manually actuable to clamp the crotch joint against the bottom of the groove to keep the crotch joint fixed in position.

The measurement frame is provided with a waist measuring instrument 34, a thigh measuring instrument 36 and a cuff measuring instrument 38. Additionally, the frame is provided with a front rise measuring instrument 42, a rear drop measuring instrument 48 and an inseam measuring instrument 46. These measuring instruments will be described in detail below.

Figure 4:
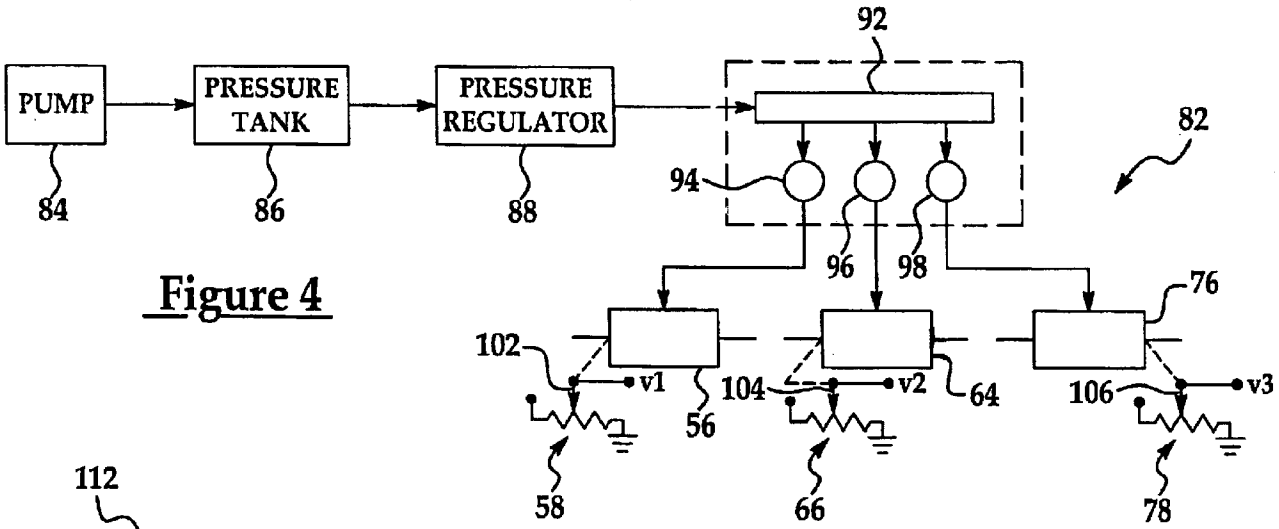
FIG. 4 is a schematic diagram representing a pneumatic actuation system for the measuring apparatus.

The waist measuring instrument 34 comprises a pair of waist measurement probes, suitably in the form of waist retainer members 52*a* and 52*b*; it also comprises a double-ended linear pneumatic actuator 56 and an electrical measuring transducer 58 (see FIG. 4). The measuring instrument 34 is mounted on a carrier plate 57 which is slidably supported for up and down movement on a pair of vertical support rods 54*a* and 54*b*.

The retainer members 52*a* and 52*b* are mounted on opposite ends of the two piston rods of the pneumatic actuator 56 for lateral extension and retraction under operator control for tensioning and measuring the waistband of a trousers. The actuator 56 is coupled with the electrical transducer 58 which produces a waist measurement signal corresponding to the position of the retainer members 52*a* and 52*b* relative to each other. The waist measurement signal is proportional to the waist dimension of the trousers.

Figure 2:
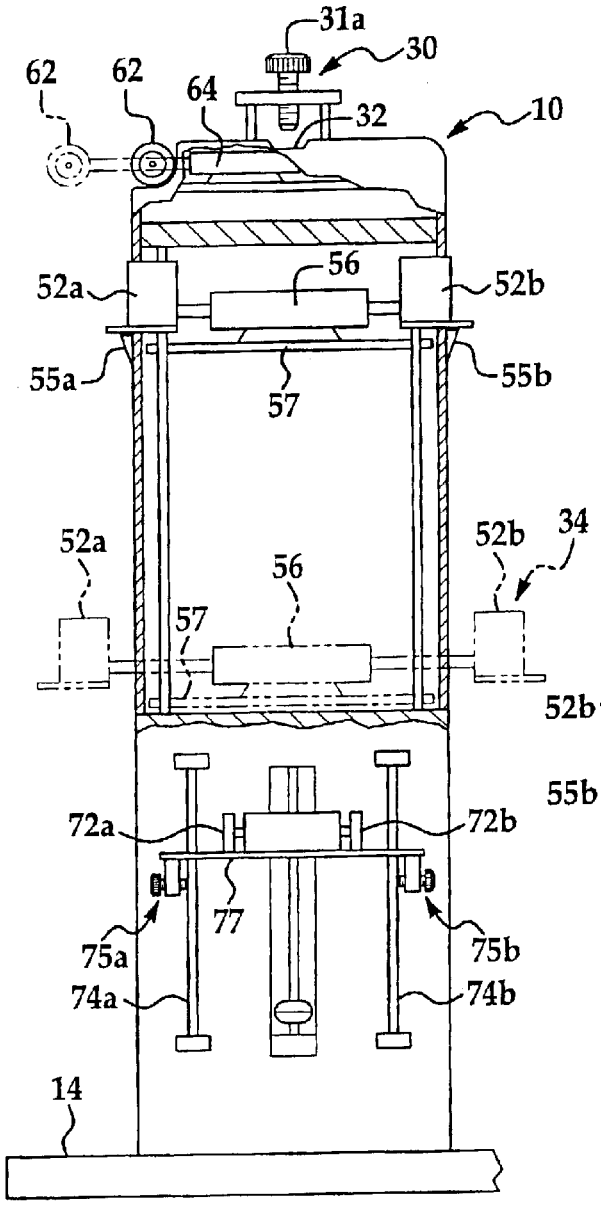
FIG. 2 is a front elevation view of the measuring apparatus of FIG. 1.
Figure 3:
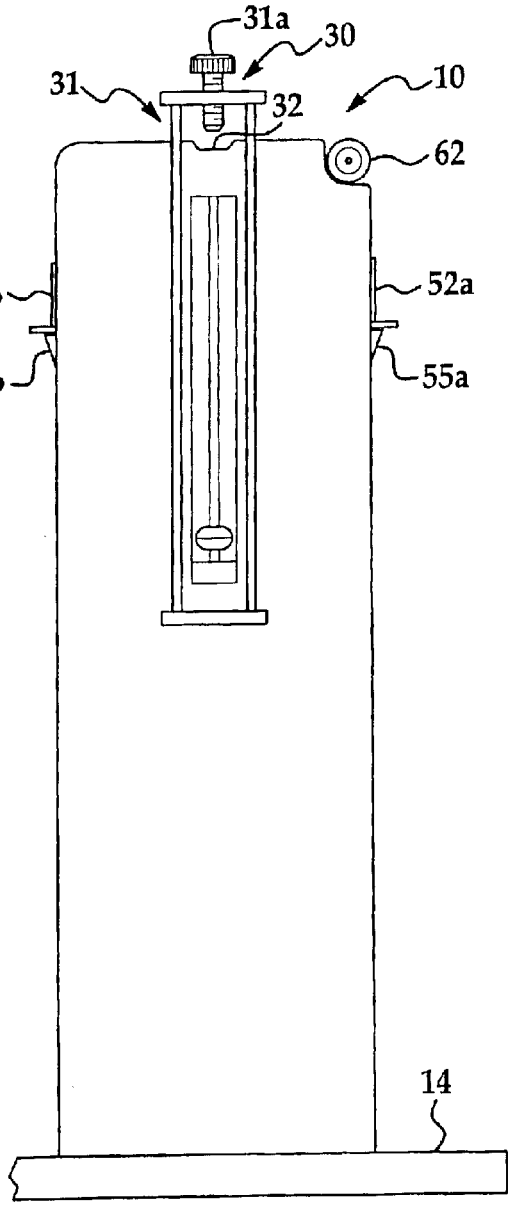
FIG. 3 is a rear elevation view of the measuring apparatus of FIG. 1.

The waist measuring instrument 34 is shown in FIG. 2 (in solid lines) in its upper or retracted position; also, it is shown (in dashed lines) in its lower or extended position. The instrument 34 is retained in its retracted position by a pair of manually releasable detents 55*a* and 55*b*. Each of the detents is a spring finger which is pivotable around its lower end on the measurement frame 12 and, in its unstressed condition, its upper end protrudes outwardly of the frame and provides a stop surface for engaging the lower edge of the associated retainer member so that the carrier plate 57 is held in its retracted position. When the detents 55*a* and 55*b* are depressed inwardly of the frame, the carrier plate 57 tends to slide downwardly under its own weight on the rods 54*a* and 54*b*. The waist measuring instrument 34 is returned manually to its retracted position by sliding it upwardly; in this movement, the detent members 55*a* and 55*b* are cammed inwardly by the retainer members 52*a* and 52*b*, respectively. When the retainer members move beyond the detents the detents spring outwardly to provide stop surfaces to retain the instrument in its retracted position.

The thigh measuring instrument 36 comprises a measuring probe, suitably in the form of a roller 62 which is mounted on the piston rod of a single-ended linear pneumatic actuator 64. The actuator 64 is coupled with a transducer 66 (see FIG. 4) which produces a thigh measurement signal corresponding to the position of the roller for measurement of the thigh dimension of a trouser.

The cuff measuring instrument 38 comprises a pair of cuff measurement probes, suitably in the form of cuff retainer members 72*a* and 72*b*; it also comprises a double-ended linear pneumatic actuator 76 and an electrical measuring transducer 78 (see FIG. 4). The measuring instrument 38 is mounted on a carrier plate 77 which is slidably supported for up and down movement on a pair of vertical support rods 74*a* and 74*b*.

The retainer members 72*a* and 72*b* are mounted on opposite ends of the two piston rods of the pneumatic actuator 76 for lateral extension and retraction under operator control for tensioning and measuring the cuffs of a trousers, as will be described below. The actuator 76 is coupled with the electrical transducer 78 which produces a cuff measurement signal corresponding to the position of the retainer members 72*a* and 72*b* relative to each other. The cuff measurement signal is proportional to the cuff dimension of the trousers.

The cuff measuring instrument 38 is shown in FIG. 2 (in solid lines) in its upper or retracted position; it is shown (in dashed lines) in its lower or extended position. The instrument is retained in its retracted position by a pair of manually actuated brakes 75*a* and 75*b*. The brakes 75*a* and 75*b* are mounted on the lower side of the carrier plate 77 in alignment with the support rods 74*a* and 74*b*, respectively. Each brake comprises a threaded block 79 which carries a hand-screw 79' which can be manually turned to apply or release the brake. When the brakes are released, the carrier plate 77 tends to slide downwardly under its own weight on the rods 74*a* and 74*b*. The cuff measuring instrument 38 is returned manually to its retracted position by sliding it upwardly and the brakes are applied to hold it in place.

The front rise measuring instrument 42 is mounted on the upper portion of the frame 12 on the front surface thereof and extends along the vertical center line. The instrument 42 is an electronic ruler for measuring linear dimensions. In a preferred form, this instrument 42 is an electrical transducer; specifically, it is a linear DC potentiometer. The potentiometer and its wiper contact (not shown) is housed in a thin elongated casing 43. The contact has a handle 44 which carries an index line 44' and which is manually positionable in a vertical slot 45 extending along the length of the casing. When the handle 44 is depressed, the wiper contact engages the linear resistor element of the potentiometer and produces a signal voltage corresponding to the position of the index line 44' along the length of the slot 45. The use of the front rise measuring instrument will be described below.

The inseam measuring instrument 46 is an electronic ruler of the same type as the front rise measuring instrument 42. It is suitably located in vertical alignment with and just below the front rise measuring instrument. The instrument 46 has a handle 47 which carries an index line 47'. The use of the inseam measuring instrument will be described below.

The rear drop measuring instrument 48 is also an electronic ruler of the type described above. It is located on the rear surface of the frame 12 and is mounted on the upper portion of the frame 12 and extends along the vertical center line. The instrument 48 has a handle 49 which carries an index line 49'. The use of this instrument for measuring the rear rise dimension of the trousers will be described below.

The pneumatic actuating system 82 of the measuring apparatus is shown in the schematic diagram of FIG. 4. In general, the system includes an air pump 84 which supplies pressurized air to a pressure tank 86. The pressurized air is supplied from the tank to a pressure regulator 88 which maintains a substantially constant pressure on the supply line. The regulator is set to maintain a predetermined value of air pressure to the actuators which will produce an accurate measurement of the critical dimensions of the garment. The regulated supply line is connected to an input manifold 92 and thence to the individual control valves 94, 96 and 98 for the respective pneumatic actuators 76, 56 and 64. The manifold 92 and the control valves are installed in the control panel 22 within convenient reach of the operator of the measuring apparatus. The control valve 94 is connected with the waist actuator 56, control valve 96 is connected with the thigh actuator 64 and control valve 98 is connected with the cuff actuator 76. The waist and cuff actuators 56 and 76 are double-ended actuators with dual pistons which are both energized from the same control valve. The thigh actuator 64 is a single-ended actuator as described above.

The valving arrangement for control valves 94, 96 and 98 provides a single handle control which energizes the respective pistons in the "retract" direction when the handle is turned counterclockwise to the "R" position and the pistons are energized in the "extend" direction when the handle is turned clockwise to the "E" position. Each of the pistons of the actuators are suitably damped so that the movement in the extend and retract directions is relatively slow and smooth. The air pressure supplied to each of the pistons is regulated at a value which causes the fabric of the garment being measured to be tensioned to a degree which simulates that to which it would be subjected to when the garment is worn. Thus, when the desired tension is achieved during the actuation in the extend direction, the motion of the piston stops and holds the desired tension in the fabric.

The electrical transducer 58 is a DC potentiometer having a movable contact 102 in wiping engagement with the resistance element and mechanically coupled with the piston of the actuator 56 as indicated by the dashed line connection 102'. Accordingly, a waist measurement signal voltage, v1, is produced on the wiper contact 102 which is proportional to the movement of the piston from its reference position. Similarly, the transducer 66 is a DC potentiometer having a wiper contact 104 which develops a signal voltage v2 corresponding to the measurement of the thigh dimension. Likewise, the measurement transducer 76 is a DC potentiometer having a movable contact 106 which produces a signal voltage v3 corresponding to the measurement of the cuff dimension.

Figure 5:
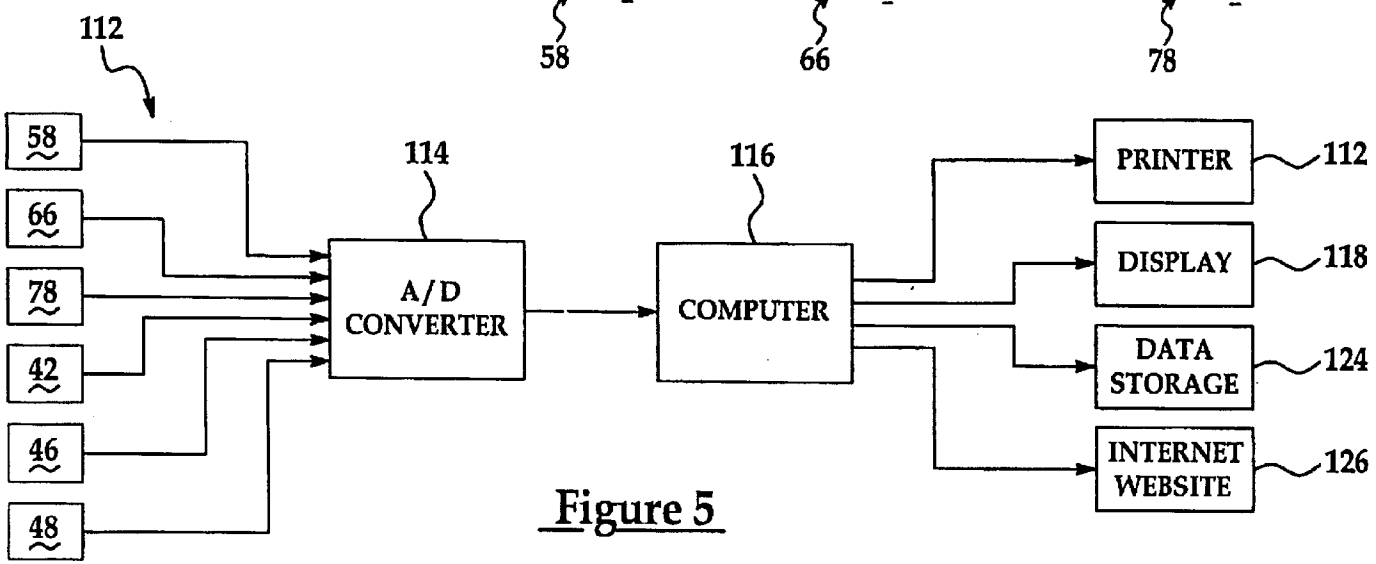
FIG. 5 is a block diagram representing an electronic measuring system.

FIG. 5 is a functional block diagram of the electronic measurement system 112 of the garment measuring apparatus 10 for obtaining the critical dimensions of a garment being measured. The electronic measurement system 112 comprises the waist measuring transducer 58, the thigh measuring transducer 66, the cuff measuring transducer 78, the front rise measuring instrument 42, the inseam measurement instrument 46 and the rear drop measuring instrument 48. The individual signals from these transducers are applied through an analog-to-digital (A/D) converter 114 to an input bus of a computer 116. Each of the individual measurement signals is processed under program control in the computer 116 which also provides temporary storage of the measurement signals. The set of measurement signals for the garment being measured is sent to the electronic display 118 as the measurement proceeds. Also, the measurement signals are transmitted selectively by the computer 116 to a printer 122, a data storage medium 124 and/or an internet website 126 upon completion of the set of measurements.

Use of the Measuring Apparatus

The use of the measuring apparatus will now be described for determining the critical dimensions of a trouser. First, the operator places the trouser 20 (see dashed line in FIG. 1) on the measurement frame 12 with the measuring instruments 34, 36 and 38 in the idle condition, i.e. the actuators 56, 62 and 76 are in the retracted positions. With the fly of the trouser closed, the operator turns the trouser upside down and slips the waistband A over the upper end of the measurement frame with the fly of the trouser at the front of the frame. Note that the waistband is inserted under the keeper clamp 30 so that the trunk portion B of the trouser is under the support bracket assembly 31 on the rear side of the frame. The waistband of the trouser is positioned over the retainer members 52*a* and 52*b* in a loose condition and the crotch joint of the trouser is positioned over the bulls eye 28'. With the crotch joint positioned, the keeper clamp 30 is moved from its open position to a clamping position against the crotch joint to keep the crotch joint in fixed position during the measurement procedure. Next, one leg C and its cuff E of the trouser is draped over the front of the measurement frame and the other leg D of the trouser is draped over the rear of the measurement frame. Then the operator positions the edge of the waistband in contact with the shelf portion of the retainer members 52*a* and 52*b*. With the trouser in this position, the operator turns the control handle of the waist actuator valve 94 to the extend ("E") position. This causes the waist retainer members 52*a* and 52*b* to be extended and to apply tensioning force at the waistband of the trouser simulating that which would occur when the trousers are worn. When the waist actuator 56 is energized to its extended position, the measurement transducer 58 generates a signal corresponding to the waist dimension. This signal is applied to the computer 116 and thence to the printer 122, display 118, data storage 124 and/or internet website 126 as may be selected by the operator through the control panel 22.

The front rise measurement may be taken next while the trouser waistband is still retained by the retainer members 52*a* and 52*b*. For this purpose, the operator releases the detents 55*a* and 55*b* of the waist measuring instrument 34 and allows it to drop under its own weight on the slide rods 54*a* and 54*b* with the trouser being held at the waistband by the retainer members. This places the fabric of the trouser between the waistband and the support surface 28 of the frame in a tensioned condition approximating that which would occur when the trousers are worn. With trouser in this condition, the front rise dimension is measured as follows. The operator moves the handle 44 of the front rise measuring instrument 42 to a position in which the index line 44' is aligned with free edge of trouser waistband. With the index line 44' in this position, the operator presses the handle 44 inwardly so that the electrical wiper contact engages the potentiometer resistor. This causes the front rise signal voltage, which corresponds to the front rise dimension, to be applied to the computer 116 whereby the signal is processed and transmitted as described above for the waist measurement signal.

The thigh measurement may be taken next while the waistband is still retained by the retainer members 52*a* and 52*b*. For this purpose, the operator actuates the valve 96 to the extend position to energize the actuator 64 which moves the roller 62 to an extended position against the fabric of the trouser and tension it between the roller and the keeper clamp 30, thus simulating the tension in the fabric when the trousers are worn. In this position of the roller 62, the measurement transducer 66 generates a signal corresponding to the thigh dimension. This signal is applied to the computer 116 and is processed as described above.

The cuff measurement may be taken next with the waistband of the trouser retained by the retainer members 52*a* and 52*b*. For this purpose, the cuff of the trouser leg on the front of the measuring apparatus is positioned to encircle the retainer members 72*a* and 72*b* of the cuff measuring instrument 38. Then the operator positions the lower edge of the cuff in contact with the shelf portion of the retainer members and turns the control handle of the cuff actuator valve 98 to the extend position. This causes the cuff retainer members to be extended and to apply tensioning force which is just sufficient to place the fabric in a smooth, unwrinkled condition. In this condition the measurement transducer 66 generates a signal corresponding to the cuff dimension. This signal is applied to the computer 116 and is processed thereby as described above.

The inseam measurement may be taken next while the waistband of the trouser is still retained by retainer members 52*a* and 52*b* and while the cuff of the trouser is still retained by the retainer members 72*a* and 72*b*. For the purpose of taking the inseam measurement, the operator releases the brakes 75*a* and 75*b* on a carrier plate 77 of the instrument 38. This allows the instrument to drop under its own weight on the slide rods 74*a* and 74*b* while the cuffs of the trouser are held by the retainer members 72*a* and 72*b*. This places the fabric of the trouser legs between the cuffs and the support surface 28 of the frame in a tensioned condition approximating that which would occur when the trousers are worn. With the trouser in this condition, the inseam dimension, i.e. the distance between the crotch joint of the trouser and the lower edge of the cuff, is measured as follows. The operator moves the handle 47 to a position in which the index line 47' is aligned with the lower edge of the cuff and presses the handle 47. This causes the inseam signal voltage, which corresponds to the inseam dimension, to be applied to the computer 116 whereby the signal is processed and transmitted as described above.

The rear drop measurement may be taken next while the waist actuator 56, thigh actuator 64 and cuff actuator 76 are still actuated and in the extended position. The measurement of the rear drop dimension is taken, using the rear rise measuring instrument 48 in the same manner as the front rise measuring instrument 42 as described above.

After all of the critical dimensions are measured, as described above, the operator turns all of the actuator valves 94, 96 and 98 to the tract ("R") position. This causes the waist retainer members 52*a* and 52*b*, the thigh roller 36 and the cuff retainer members 72*a* and 72*b* to be withdrawn to retracted position thereby releasing all tension on the fabric of the trouser. The keeper clamp 30 is manually released and the trouser may be removed from the measurement frame 12. Then, the waist measuring instrument 34 may be manually raised to the retracted position and released whereby the detents 55*a* and 55*b* hold it in its retracted position. Also, the cuff measuring instrument 38 may be manually raised to its retracted position and the brakes 75*a* and 75*b* are tightened to hold it in position. This places the measuring apparatus in condition for initiating a cycle of measurements on another trouser.

Second Embodiment of Garment Measuring Apparatus

Figure 8:
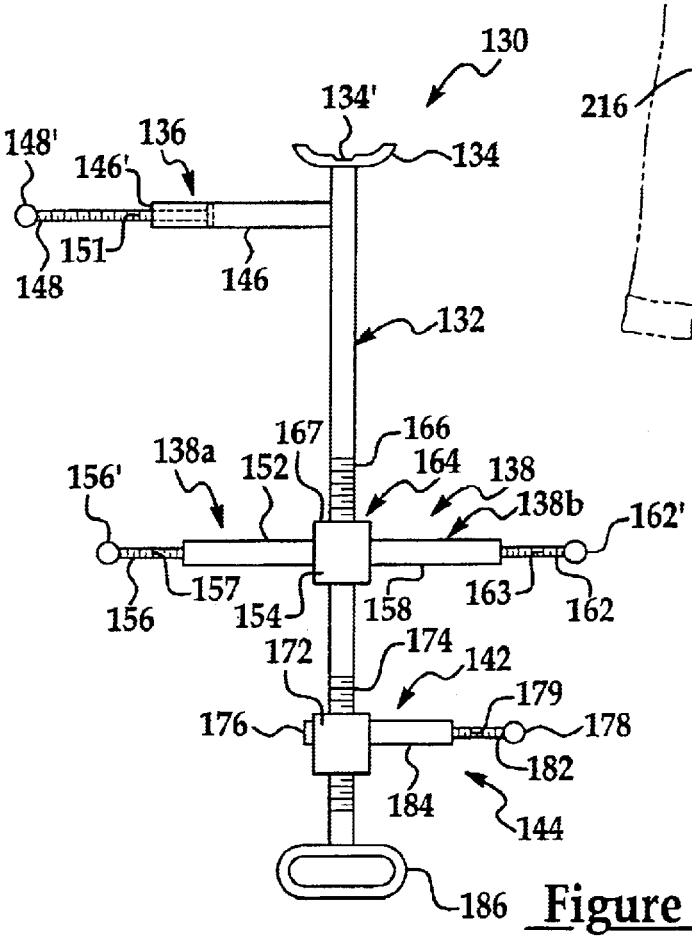
FIG. 8 is a diagram of a compact version of the measuring apparatus for trousers.

FIG. 8 shows a second embodiment of the measuring apparatus for measuring the critical dimensions of trousers. This measuring apparatus is a portable instrument of compact design for operation by manual manipulation to obtain a set of critical dimensions.

The measuring instrument 130 is adapted to measure dimensions of a trouser including the waist, thigh, drop/rise, cuff and inseam. In general, the instrument 130 comprises a trunk member 132 which supports a garment positioning device 134, a thigh measuring instrument 136, a waist measuring instrument 138, a drop/rise measuring instrument 154, an inseam measuring instrument 142 and a cuff measuring instrument 144.

The trunk member 132 comprises a cylindrical rod 152 which supports the garment positioning device 134 on one end and which supports the inseam measuring instrument 142 and the cuff measuring instrument 144 rear the other end. A handle 186 is provided on said other end for convenience of the operator. The thigh measuring instrument 136 is mounted on the trunk member 132 closely adjacent the positioning device 134 and extends perpendicularly from the trunk member. The waist measuring instrument 138 is slidably mounted on the trunk member 132 at a position intermediate the inseam measuring instrument 142 and the positioning device 134. Preferably, the garment positioning device 134 is trough-shaped, suitably semi-cylindrical, and is oriented with its longitudinal axis perpendicular to the plane defined by the thigh measuring instrument 136 and the trunk member 132. The positioning device 134 defines a recess 134' in alignment with the trunk member 132.

The garment positioning device 134, thigh measuring instrument 136 and the waist measuring instrument 138 are adapted to support a trouser in position for taking measurements of the critical dimensions of the trouser. For this purpose, the operator places the trouser (not shown) on the measuring apparatus as follows. With the fly of the trouser closed, the operator turns the trouser upside down and slips the waistband over the upper end of the measurement apparatus with the fly of the trouser approximately centered and disposed on either the front or the rear side of the measuring apparatus 130. The crotch joint of the trouser is positioned in the recess 134, which serves as a reference joint for taking certain measurements.

The thigh measuring instrument 136 comprises a tubular arm 146 which is fixedly mounted on the trunk member 132 with its longitudinal axis disposed perpendicularly to the axis of the trunk member 132. A telescopic rod 148 has a slidable telescopic connection with the distal end of the tubular arm 146. The rod 148 carries a measurement scale 151 and serves as a sliding ruler. For this purpose, the telescopic rod 148 is provided with a knob 148' at its distal end which facilitates slidable adjustment of the position of the rod 148 by the operator. The distal end of the tube 146 has a flat face 146' which serves as a reference index line for the ruler scale on the rod 148. The flat face 146' is a predetermined distance, say 15 inches, from the center line of the trunk member 132. The rod 148 is graduated, for example in a scale of inches, in ascending order from its distal end to its proximate end. For example the scale would range from "15" inches to "30" inches between its distal and proximate ends.

The waist measuring instrument 138 comprises oppositely extending arms 138*a* and 138*b*. The arms are of equal length and lie in the same plane as that defined by the trunk member 132 and the thigh measuring instrument 136. The arm 138*a* comprises a tube 152 which is mounted on the member 132 by a slidable coupling 154 which encircles the trunk member and can be manually adjusted along the length of the trunk member. The arm 138*a* also comprises a telescopic rod 156 which has a telescopic connection with the distal end of the tube 152. The rod 156 has a knob 156' at its distal to facilitate manual adjustment. The telescopic rod 156 is provided with a measurement scale 157 and coacts with the tube 152 to serve as a sliding ruler in the same manner as the measuring instrument 136 described above. Similarly, the arm 138*b* comprises a tube 158 fixed to the slidable coupling 154 and supports a telescopic rod 162 which carries a measurement scale 163 and has a knob 162' as described with respect to the arm 38*a*.

The drop/rise measuring instrument 154 comprises the slidable coupling ring 154, which as described above, is manually adjustable along the length of the trunk member 132. The drop/rise measuring instrument also comprises a measurement scale 166 on the trunk member 132 and is adapted to take measurements of both the front rise and the rear drop of the trouser being measured. The upper end of the slidable coupling 154 has a flat face 167 which serves as an index line for taking the measurements on the scale 166 of either the drop or the rise of the trouser. The drop/rise scale 166 is indicative of the distance from the recess 134' of the positioning device 134 to the measured position on the scale.

The inseam measuring instrument 142 comprises a slidable coupling ring 172 which is slidably mounted on the trunk member 132. The instrument 142 also comprises a measurement scale 174 on the trunk member. The upper end of the slidable coupling ring 172 has a flat face and serves as an index line for reading the scale 174. The inseam scale 174 is indicative of the distance from the recess 134' to the measured position on the scale.

The cuff measuring instrument 144 comprises a fixed cuff retainer 176 which is fixedly mounted on the slidable coupling ring 172. It also comprises an adjustable cuff retainer in the form of a knob 178 which is disposed on the distal end of a telescopic rod 182 which is in telescopic connection with a tube 184. The tube is fixedly mounted to the coupling ring 172. The telescopic rod 182 is provided with a measurement scale 179 which measures the cuff dimension.

The manner of use of the measuring apparatus 130 for obtaining the critical dimensions of a trouser is analogous to that of the measuring apparatus 10 described above.

Measuring Apparatus for Shirts and Jackets

Figure 6:
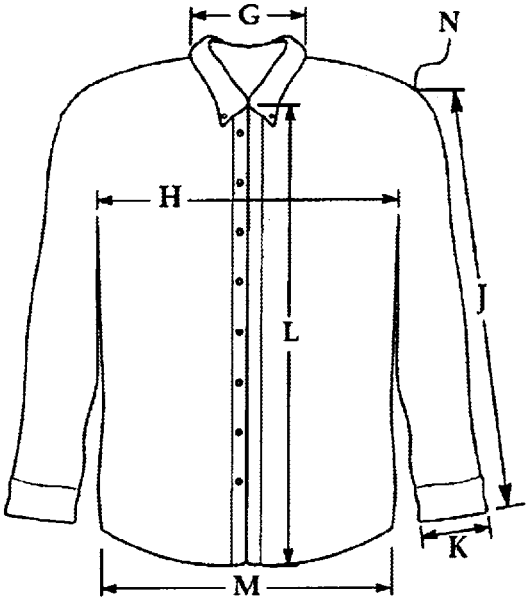
FIG. 6 depicts a portion of a measuring apparatus for obtaining critical dimensions of shirts or jackets.
Figure 7:
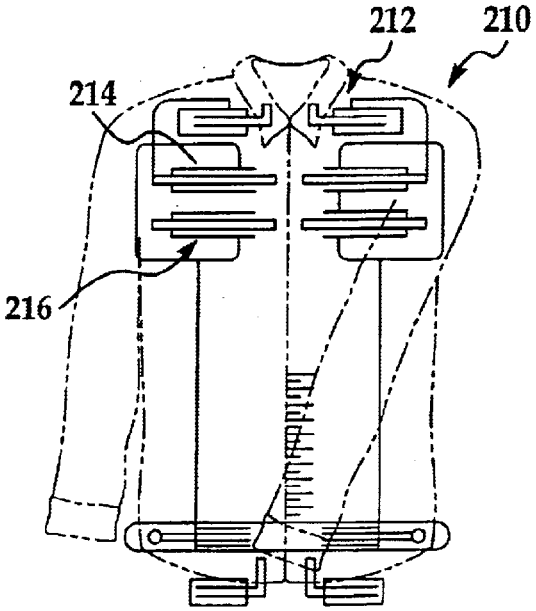
FIG. 7 indicates critical dimensions selected for shirts and jackets.

FIGS. 6 and 7 show an embodiment of the measuring apparatus of this invention for use in measuring the critical dimensions of shirts and jackets. The measuring apparatus of FIG. 7 is implemented using pneumatic actuators analogous to those of FIGS. 1–4 and are illustrated diagrammatically.

The critical dimensions of a shirt are given as an example in FIG. 6. The critical dimensions include the neck size G, the chest size H, the arm length J, the cuff size K, the waist length L and the waist perimeter M. It is noted that the arm length J is measured from a reference point on the seam joint N on the shoulder and the waist length L is measured from the collar button at the neck of the shirt.

The measuring apparatus 210 is depicted in FIG. 7. In this figure, only the actuators of the neck measuring instrument 212, chest measuring instruments 214 and 216, sleeve measuring instrument 218, cuff measuring instrument 222 and bottom measuring instrument 224 are illustrated. Likewise, only the measurement scale is illustrated for the waist length measuring instrument 226 is illustrated. The principles of operation and the implementation of the measuring instruments, as well as the manner of use, are analogous to that described for the trouser measuring apparatus of FIGS. 1–5.

CONCLUSION

Although the description of this invention has been given with reference to particular embodiments it is not to be construed in a limiting sense. Many variations and modifications will now occur to those skilled in the art. For a definition of the invention, reference is made to the appended claims.

I claim:

1. A method of fitting a ready-made garment to the body of an individual person with a fit that meets the individual person's preference, said method comprising the steps of:

selecting an existing garment from said individual person's own wardrobe, said garment having a preferred fit on said individual person, measuring a prescribed set of critical dimensions of said existing garment and recording said dimensions with an identification of the individual person, and manufacturing one or more garments having said critical dimensions.

2. The method as defined in claim 1 wherein:

said set of critical dimensions includes dimensions which will result, after cutting and sewing the garment, in a garment which will conform to the individual person's body in a preferred fit, measuring at least some of said critical dimensions from a common datum point on the selected garment.

3. The method as defined by claim 2 wherein said garment is a trousers, said method including the steps of:

selecting the inseam sewing junction in the crotch of the trousers as the datum point for measuring the inseam, the rise and the drop of the trousers.

4. A measuring apparatus for obtaining measurements of critical dimensions of a trousers in said apparatus comprising:

an upright measurement frame adapted to support said trousers for measurement by measuring instruments installed on said frame, said frame being a generally rectangular box-like structure adapted to support plural measuring instruments, said measurement frame terminating at its upper end in a horizontal support surface having a datum point thereon at a central location on said support surface, means for holding the crotch joint of a trousers in position at said data point during measurements of said trousers, a waist measuring instrument mounted on said measurement frame including a pair of oppositely disposed measurement probes for receiving the waist band of said trousers and measuring the girth thereof, a thigh measuring instrument disposed at the upper end of said measuring frame comprising a measurement probe for measuring the girth in the thigh region of said trousers, a cuff measuring instrument comprising a pair of cuff measurement probes disposed at the lower end of said measurement frame for measuring the girth of one of the cuffs of said trousers, a front rise measuring instrument including a measurement probe mounted on the upper portion of the measurement frame on the front surface thereof and extending along a vertical centerline of the measurement frame for measuring the front rise of said trousers, a rear drop measuring instrument including a measurement probe mounted on the rear surface of said measurement frame at the upper portion thereof and extending along a vertical centerline thereof for measuring the rear drop of said trousers, and an inseam measuring instrument including a measurement probe mounted on one of said front and rear surfaces of the measurement frame in vertical alignment with the front rise measuring instrument for measuring the inseam of said trousers.

5. The apparatus as defined in claim 4 including:

pneumatic actuating means for said measurement probes, and an electrical transducer coupled with each of said probes for reading the measurement thereof.

* * * * *